US009528165B2

(12) United States Patent
Herbst et al.

(10) Patent No.: US 9,528,165 B2
(45) Date of Patent: Dec. 27, 2016

(54) APPARATUS FOR THE CONTINUOUS THERMAL TREATMENT OF ELECTRICALLY CONDUCTIVE CONTINUALLY CAST MATERIAL AND ARRANGEMENT OF A SLIDING CONTACT ELEMENT

(75) Inventors: Gerhard Herbst, Rednitzhembach (DE); Rainer Schwarz, Schwabach (DE)

(73) Assignee: SCHUNK KOHLENSTOFFTECHNIK GMBH, Heuchelheim (DE)

( * ) Notice: Subject to any disclaimer, the term of this patent is extended or adjusted under 35 U.S.C. 154(b) by 245 days.

(21) Appl. No.: 14/003,173

(22) PCT Filed: Jan. 18, 2012

(86) PCT No.: PCT/EP2012/000220

§ 371 (c)(1), (2), (4) Date: Nov. 15, 2013

(87) PCT Pub. No.: WO2012/123048

PCT Pub. Date: Sep. 20, 2012

(65) Prior Publication Data

US 2014/0084523 A1 Mar. 27, 2014

(30) Foreign Application Priority Data

Mar. 14, 2011 (DE) ..... 10 2011 013 827

(51) Int. Cl.
*H01R 39/64* (2006.01)
*C21D 9/00* (2006.01)
(Continued)

(52) U.S. Cl.
CPC ..... *C21D 9/0006* (2013.01); *C21D 9/562* (2013.01); *C21D 9/62* (2013.01); *H01R 39/383* (2013.01); *H01R 39/64* (2013.01)

(58) Field of Classification Search
CPC ..... C21D 9/0006
(Continued)

(56) References Cited

U.S. PATENT DOCUMENTS 4,110,651 A 8/1978 Fagan
5,631,513 A 5/1997 Coles et al.
(Continued)

FOREIGN PATENT DOCUMENTS

DE 3405193 A1 8/1985
DE 29702808 U1 4/1997
(Continued)

OTHER PUBLICATIONS

International Search Report from corresponding International Application PCT/EP2012/000220, dated Jun. 5, 2012.
(Continued)

*Primary Examiner* — Scott Kastler
(74) *Attorney, Agent, or Firm* — Greer, Burns & Crain, Ltd.

(57) ABSTRACT

In an apparatus for the continuous thermal treatment of metal continuously cast material having a heating section, the metal continuously cast material having a heating section, the metal continuously cast material is led over two contact rollers, wherein the first contact roller is arranged at a first end and the second contact roller is arranged at a second end of said heating section. Both contact rollers are connected to a voltage source in such a way that a current flows through the metal continuously cast material between the first and the second contact roller. Here, electrical contact is made with one of the contact rollers via a sliding contact element, which is in electrical contact with a slip-ring disk arranged concentrically with the axis of said
(Continued)

contact roller. The sliding contact element is arranged on a current-carrying element using a plug-in connection which can be detached by pulling and which has at least one resilient and electrically conductive fixing element.

6 Claims, 4 Drawing Sheets

(51) Int. Cl.
*C21D 9/56* (2006.01)
*C21D 9/62* (2006.01)
*H01R 39/38* (2006.01)

(58) Field of Classification Search
USPC ..... 266/103
See application file for complete search history.

(56) References Cited

U.S. PATENT DOCUMENTS

| | | | | |
|---|---|---|---|---|
| 5,885,523 | A | 3/1999 | Lohmüller et al. | |
| 2008/0296995 | A1* | 12/2008 | Yu | H01R 39/41 310/239 |
| 2014/0084523 | A1* | 3/2014 | Herbst | C21D 9/562 266/103 |

FOREIGN PATENT DOCUMENTS

| | | | |
|---|---|---|---|
| EP | 0971474 | A1 | 1/2000 |
| GB | 2033168 | A | 5/1980 |
| JP | S50-094409 | A | 7/1975 |
| JP | S55-150681 | | 4/1979 |
| JP | 59222535 | A | 12/1984 |
| JP | 63-066054 | U | 5/1988 |
| JP | U05-029268 | | 4/1993 |
| SU | 148078 | A1 | 11/1961 |
| SU | 1038371 | A2 | 8/1983 |
| WO | 2005/090208 | A1 | 9/2005 |
| WO | 2008/000301 | A1 | 1/2008 |

OTHER PUBLICATIONS

Russian Office Action for Corresponding Russian Patent Application No. RU 2013145708, issued Aug. 24, 2015.

Japanese Office Action for Corresponding Japanese Patent Application No. JP 2013-558311, issued Aug. 31, 2015.

Search Report and Examination Report of the Japanese Patent Office for Japanese Patent Application No. 2013-558311 dated Apr. 4, 2016.

* cited by examiner

APPARATUS FOR THE CONTINUOUS THERMAL TREATMENT OF ELECTRICALLY CONDUCTIVE CONTINUALLY CAST MATERIAL AND ARRANGEMENT OF A SLIDING CONTACT ELEMENT

BACKGROUND

The invention relates to a device for the continuous heat treatment of electrically conductive extruded material and to an arrangement of a sliding contact element, as is used in such devices. The invention is described in connection with a device for the continuous heat treatment of electrically conductive extruded material, particularly with an annealer for metallic wires, which is also termed a continuous wire annealer. However, the core of the invention is an arrangement of a sliding contact element which can also be applied advantageously in connection with other devices or methods.

In the case of conductive continuous wire annealers, which are also termed continuous wire resistance annealers, the current supply to the wire to be heated with the aid of an electric current takes place via contact discs, contact tubes or contact rollers, by means of which the current is introduced into the wire. DE 10 2009 008 695 A1, the content of which is hereby explicitly and completely made part of the disclosure of the present description, describes an arrangement, a product and a method for fastening such a contact tube on a shaft of a continuous wire resistance annealer.

SUMMARY

Continuous wire annealers are often used in connection with devices for drawing wire for heat treatment of the drawn wires. DE 11 79 724 describes a device and a method for drawing and subsequent annealing of wires and explains the interaction of both processes in the production of the finest metal wires. DE 10 2007 019 289 A1 discloses a modern device and a corresponding method for drawing wire.

An annealing device for the annealing treatment of metallic extruded material with a plurality of contact discs is described in DE 199 39 399 A1. The contents of these three published documents, that is to say DE 11 79 724, DE 10 2007 019 289 A1 and DE 199 39 399 A1 are also hereby explicitly and completely made part of the disclosure of the present description.

DE 196 14 586 B4, the content of which is hereby explicitly and completely made part of the disclosure of the present description, describes a further example of such a continuous wire annealer. The manner in which the contact rollers of such a continuous wire annealer are electrically contacted via "carbon" or carbon brushes, that is to say via wear-prone sliding contact elements, is described in particular in DE 196 14 586 B4. These carbon brushes are wear parts which have to be replaced relatively frequently by new parts. Carbon brushes consist for the most part of graphite (http://de.wikipedia.org/wiki/Kohlebürste). Depending on the use case, they are to some extent additionally enriched with metallic components (copper, silver, molybdenum) and also with binding agents (pitch, resins or plastic powder). Or, they consist of metal exclusively. In these cases, they are also called "brushes" and the bristles consist of metal wires.

Wire contacts in potentiometers, rotary switches and on current collectors consist of the same materials, but are termed a sliding strip in the case of current collectors and a slider in the case of potentiometers.

The present invention is based on the object of specifying a technical teaching with which the problems caused by the high susceptibility to wear of the sliding contact elements in such continuous wire annealers are alleviated.

According to the invention, this object is achieved by means of an arrangement of at least one sliding contact element on or at a current supply element by means of a plug connection, which can be detached by being pulled off and which comprises at least one elastic and electrically conductive fastening element.

In this context, a sliding contact element is to be understood to mean an electrically conductive object which is constructed such that it is suitable for electrically contacting a movable conductor. Examples for such sliding contact elements are carbon brushes or other, preferably metallic conductor arrangements which can preferably be pushed on with the aid of elastic or pneumatic mounts on the movable conductors to be contacted. Particularly in the case of current transmission to rotating systems, carbon brushes are used, which run on slip rings or on commutators. Further examples for sliding contact elements are sliding shoes which contact wires or rails. In this case, the current is preferably conducted via connections with copper strands, which are then securely connected by means of stamping, rivet or adhesive contacts to the sliding contact element, which is preferably made from a wearing material, particularly preferably produced on the basis of graphite.

Preferably, the materials used to construct a sliding contact element are softer than the material of the conductor to be contacted, so that the same is protected from wear. Due to the friction on the surface of the conductor to be contacted, the softer sliding contact element wears in the course of longer operation, for which reason, the worn sliding contact elements regularly have to be replaced with new sliding contact elements. The arrangement according to the invention of at least one sliding contact element on or at a current supply element by means of at least one plug connection, which can be detached by pulling off and which comprises at least one elastic and electrically conductive fastening element, alleviates the problems connected herewith, because the plug connection according to the invention enables a simple replaceability of the sliding contact elements. The worn sliding contact element, which is abraded down to the wear limit, can be separated at the end of the service life simply by pulling off from the current supply element, and a new sliding contact element can very simply be plugged onto the current supply element.

Sliding contact elements according to the invention can be designed and produced in a particularly simple manner due to the simple manner of their fastening on the current supply element. The current supply elements are subject to practically no wear and can be reused almost without limitation.

In this context, a current supply element is understood to mean an electrically conductive structural element of the arrangement according to the invention, which is electrically conductively connected to an external current or voltage source and to the at least one sliding contact element and which is preferably electrically insulated with respect to the surroundings, particularly with respect to a housing of an arrangement according to the invention or a device containing this arrangement. In addition to the electrical contacting, this current supply element is also used for holding and guiding the at least one sliding contact element. DE 196 14 586 B4 in particular, the content of which is hereby explicitly and completely made a part of the disclosure of the present description, shows an example of a current supply element in FIG. 3, which in addition to the electrical connection of the carbon brush to the current source, is also used for holding the carbon brush which is electrically insulated with respect to the housing of the wire annealer.

In this context, a plug connection is understood to mean a mechanical connection of two components, preferably at least one current supply element to at least one sliding contact element, which can preferably be produced by plugging a first component onto a second component and preferably can be detached again by pulling one of the two components off the other component. Preferably, this process does not leave behind any remaining traces, so that both components can preferably not be changed by plugging on and subsequent pulling off. Known examples of such plug connections are conventional plug connectors for connecting and separating electrical cables. In the case of electrical plug connections, one differentiates the male part of a plug connection (with outwardly pointing contact pins) from the female part (with inwardly pointing contact openings) (http://de.wikipedia.org/wiki/Steckverbinder). There are also plug connectors with plug elements of both sexes.

In order to improve the retaining force and the stability of such a plug connection, which can be detached by pulling off, the invention provides that the plug connection according to the invention comprises at least one elastic and electrically conductive fastening element.

In this context, an elastic fastening element is understood to mean a structural element of an arrangement according to the invention, which is used for the fastening, particularly improving the retaining force and the stability of a plug connection according to the invention, in that this fastening element is able by means of its elastic properties to perform a reversible shape change, which is used during the plugging together of the plug connection to build a force which, after the plugging together of the plug connection, is able to prevent or at least impede the improper detaching of the plug connection. During the existence of the plug connection, the elastic fastening element is continually under a pressure, which maintains the reversible deformation of the elastic fastening element effected during the plugging together of the plug connection, as a result of which the force built up during the plugging together of the plug connection continually prevents or at least impedes the improper detaching of the plug connection after the plugging together of the plug connection. Preferably, elastic fastening elements according to the invention therefore consist of materials which do not lose their elasticity during the service life of the sliding contact element even under the specific conditions of operation of the arrangement according to the invention, particularly under thermal and current load.

In this context, an electrically conductive elastic fastening element is to be understood to mean an elastic fastening element, the electrical conductivity of which is at least so high that the current transmission from a current supply element to the sliding contact element arranged at or on the same via the plug connection is ensured to a satisfactory degree in order to be able to fulfil the proper function of the arrangement according to the invention.

According to a preferred embodiment of the present invention, the features of which can also be combined with features of other embodiments, an arrangement with a plug connection is provided, which comprises at least one pin-shaped structure, preferably an outwardly pointing contact pin, and at least one hollow structure fitting the pin-shaped structure, preferably an inwardly pointing contact opening, wherein the pin-shaped structure, the hollow structure and the at least one elastic and electrically conductive fastening element are configured in such a manner that the elastic and electrically conductive fastening element can be placed between mutually fitting walls of the pin-shaped structure and the hollow structure during the plugging together of the plug connection.

In this context, a pin-shaped structure is understood to mean an elevated shaping, which faces out of the surface of the support of this structure and is configured in such a manner that this pin-shaped structure is suitable for constructing a plug connection in interaction with a hollow structure which fits it.

In this context, a hollow structure fitting a pin-shaped structure is understood to mean a shaping, which points inwards into the surface of the support of this structure, preferably a depression, and is configured in such a manner that this hollow structure is suitable for constructing a plug connection in interaction with a pin-shaped structure which fits it.

According to a further preferred embodiment of the present invention, the features of which can also be combined with features of other embodiments, an arrangement is provided, in which at least one fastening element annularly surrounds at least one pin-shaped structure at least to some extent. Preferably, the fastening element comprises the shape of a cylindrically shaped ring, the height and inner radius of which are dimensioned such that the ring can be pushed over at least one pin-shaped structure and can be placed on the pin-shaped structure in such a manner that the ring preferably does not protrude beyond the outer end of the pin-shaped structure and preferably sits securely on the wall of the pin-shaped structure which is covered at least to some extent by the ring, that is to say preferably is arranged such that it cannot be displaced without applying a force.

According to a further preferred embodiment of the present invention, the features of which can also be combined with features of other embodiments, an arrangement is provided, in which at least one sliding contact element is a carbon brush. Carbon brushes, particularly based on graphite, are preferred sliding contact elements in numerous applications, inter alia because they are significantly softer than metals. The mechanical properties of graphite make this material appear particularly suitable for a plug connection. The electrical conductivity of this material is also satisfactory for numerous applications.

According to a further preferred embodiment of the present invention, the features of which can also be combined with features of other embodiments, an arrangement is provided, in which at least one fastening element consists of an elastic plastic at least to some extent.

In this context, an elastic plastic is understood to mean an elastic solid body, the material of which is produced at least to some extent synthetically or semisynthetically, preferably from monomeric organic molecules by means of polymerisation of these molecules (so-called polymer plastic or simply "polymer"). Elastic polymers are also termed elastomers. Elastomers can elastically change their shape by means of pressure or expansion; after the ending of pressure or expansion, the elastomer quickly regains its original shape (http://de.wikipedia.org/wiki/Kunststoff#Elastomere). The elastomers particularly include all types of cross-linked rubber. The cross-linking preferably takes place by means of vulcanisation with sulphur, by means of peroxides, metal oxides or by means of irradiation.

The elastomers are predominantly cross-linked in a wide-meshed manner and therefore flexible. They do not become soft during heating and are not soluble in most solvents.

Thus, they are for example used for hygiene products or chemical gloves. The rubber mixture of car tyres is likewise an elastomer which obtains its properties by means of vulcanisation. Examples for elastomers are natural rubber (NR), acrylonitrile-butadiene rubber (NBR), styrene-butadiene rubber (SBR), chloroprene rubber (CR), butadiene rubber (BR) and ethylene-propylene-diene rubber (EPDM).

Elastic plastics can be electrically conductive or be made electrically conductive by means of additives. Plastics in general are seen as excellent insulators. This is because polymers completely lack the basic requirement for electrical conductivity, quasi free electrons. By adding substances (doping), which either supply electrons to the chain (reduction) or by removal (oxidation) create free positions for electron movement, it is possible to create electrically conductive polymers. Thus, for example, polyacetylene and poly(p-phenylene) become electrically conductive if one dopes them with bromine, iodine or perchloric acid. Further important electrically conductive polymers are polyaniline, doped with hydrochloric acid and polypyrrole from anodic oxidation. Conductive polymers, also termed electrically self conductive polymers are plastics with electrical conductivity. This stands in contrast to normal polymers which do not conduct the electric current. The conductivity of the polymer is achieved by means of conjugated double bonds which enable a free mobility of charge carriers. This stands in contrast to electrically conductive additives, such as for example aluminium flakes or carbon black, in the case of which the polymer itself does not conduct the electric current.

The structure of the self conductive polymers (http://de.wikipedia.org/wiki/Leitfähige_Polymere) is highly disordered, analogously to conventional plastics. They are neither soluble nor meltable in an undecomposed manner. Often, the polymers also deviate from the ideal chemical composition, as undesired side reactions may occur during formation. The structure and therefore also the physical properties are strongly influenced by the synthesis conditions. Aside from the monomer used, inter alia, the solvent, the conductive salt and the oxidation conditions have an effect on the chemical composition and the morphology of the polymer.

The electrical conductivity requires freely movable charge carriers. Therefore, electrically self conductive polymers have an extended Π electron system in the form of conjugated double bonds. Defect electrons are used as charge carriers. Polyacetylene forms an exception, in which a negatively charged polymer structure can also be created. Anions are embedded in the polymer for the charge compensation of the oxidised polymer structure. If an electric current flows, the charge carriers must also cross over from one polymer chain to an adjacent one, because the conjugated chains only have a finite length. Therefore, the overall resistance results from the sum of resistances in the polymer chains and the resistances between the chains. The higher resistance between the chains has the greater influence on the electrical conductivity. The shorter are the conjugated chains, the higher is the resistance, because the charge carriers have to transfer between the chains more often.

Ideally, the polymer structure can be electrochemically oxidised and reduced in a reversible manner. As a result, the conductivity can be varied from the insulating reduced state to the oxidised conductive state. Defect electrons are injected into the conjugated polymer chains by means of the oxidation. Initially, the conductivity rises with the number of generated charge carriers. However, an overoxidation leads to irreversible destruction of the conjugation and thus to the loss of the electrical conductivity. As the polymer chains are positively charged by the oxidation, anions are embedded into the polymer layer for charge compensation. During the reduction, they are pushed back into the electrolyte solution again. On the other hand, the embedding of cations to maintain the charge neutrality is also possible, particularly if bulky anions, which get stuck somewhat in the polymer, for example polystyrene sulphonate, are used during the synthesis. The term "doping" is also used in the case of electrically self conductive polymers. Thus, the oxidation is termed p-doping. However, this is not comparable with the classic doping of inorganic semiconductors. There, impurity atoms are introduced in comparably small concentrations. By contrast, the oxidation of the polymer structure creates the charge carriers directly and in significantly higher concentrations. In the case of thin layers, the colour of the conductive polymer is dependent on the oxidation state.

The preparation of electrically self conductive polymers can be executed chemically, electrochemically, photoelectrochemically or using CVD (chemical vapour deposition) technology. Aside from various starting compounds which are available, a broad spectrum of chemical and physical properties can be realised by means of the derivatisation thereof or by means of the formation of copolymers. The electrochemical deposition of thin layers is very simple by means of the oxidation of the monomeric starting material. The self conductive polymer is created in the oxidised conductive state. The positive charges of the polymer structure are compensated by means of the embedding of anions of the conductive salt. Important examples of self conductive polymers are polyacetylene, polyaniline, polyparaphenylene, polypyrrole and polythiophene.

According to a further preferred embodiment of the present invention, the features of which can also be combined with features of other embodiments, an arrangement according to the invention is provided as a constituent of a current supply to at least one rotating conductor. Examples of such rotating conductors are commutators, slip rings and similar or other rotating electrically conductive design elements of electrical machines or devices.

According to a further preferred embodiment of the present invention, the features of which can also be combined with features of other embodiments, an arrangement according to the invention is provided as a constituent of a current supply to at least one wire moved along its axis. Important examples of such applications are conductive continuous wire annealers, potentiometers and current collectors.

According to a further preferred embodiment of the present invention, the features of which can also be combined with features of other embodiments, an arrangement according to the invention is provided as a constituent of a device for the continuous heat treatment of metallic extruded material.

According to the invention, also provided is a method for current supply to a movable conductor with the aid of a sliding contact element which is arranged on or at a current supply element by means of a plug connection, which can be detached by being pulled off and which comprises at least one elastic and electrically conductive fastening element.

According to a preferred embodiment of the present invention, the features of which can also be combined with features of other embodiments, a method with a sliding contact configured as a carbon brush is also provided.

According to the invention, a device for the continuous heat treatment of metallic extruded material with at least one heating section is further provided, in which the metallic extruded material is guided over two contact rollers, wherein the first contact roller is arranged at a first end and the second contact roller is arranged at a second end of this at least one heating section, and wherein the first and the second contact rollers are connected to a voltage source in such a manner that a current flows through the metallic extruded material between the first and the second contact rollers, wherein at least one of the contact rollers is electrically contacted via at least one sliding contact element which is in electrical contact with a slip ring disc arranged concentrically to the axis of this contact roller. Here, the at least one sliding contact element is arranged on or at a current supply element by means of a plug connection, which can be detached by being pulled off, and the plug connection comprises at least one elastic and electrically conductive fastening element.

According to a preferred embodiment of the present invention, the features of which can also be combined with features of other embodiments, a device with at least one sliding contact element is provided, which is arranged on or at a current supply element which is securely connected to the housing of the annealing device and is electrically insulated with respect to this housing.

According to a further preferred embodiment of the present invention, the features of which can also be combined with features of other embodiments, a device with at least one sliding contact element is additionally provided, on the end of which facing away from the slip ring, a piston of a piston/cylinder apparatus acts.

According to a further preferred embodiment of the present invention, the features of which can also be combined with features of other embodiments, a device is additionally provided, in which the piston/cylinder apparatus is arranged by means of a holder on the housing of the device, electrically insulated from the same.

According to a further preferred embodiment of the present invention, the features of which can also be combined with features of other embodiments, a device is additionally provided, in which at least one sliding contact element is a carbon brush.

BRIEF DESCRIPTION OF THE DRAWINGS

In the following, the invention is explained in more detail on the basis of preferred exemplary embodiments and with the aid of figures.

In the figures

DETAILED DESCRIPTION

Figure 1A:
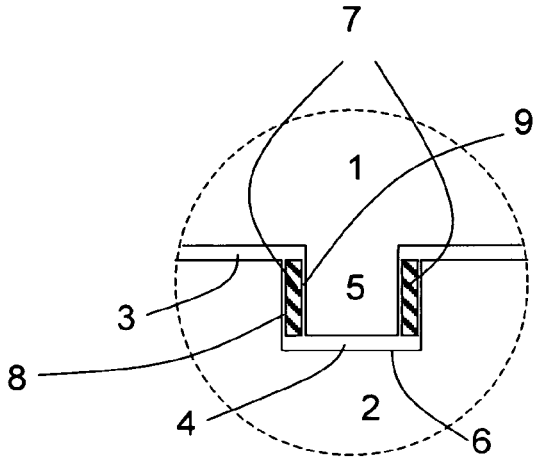
FIG. 1*a* shows a first exemplary embodiment of the arrangement according to the invention in a schematic manner.

FIG. 1*a* shows an exemplary embodiment of the invention in a schematic manner, in which the sliding contact element 1 comprises a pin-shaped structure 5 which fits into a hollow structure 6 present in the current supply element 2. None of the figures shown here are true to scale. The air gaps 3 and 4 in particular are preferably substantially smaller than illustrated in the figures. An elastic and electrically conductive fastening element 7, which in the exemplary embodiment shown in FIG. 1*a* annularly surrounds the pin-shaped structure 5 of the sliding contact element 1, is configured in such a manner that this fastening element is placed between the mutually fitting walls 8 and of the pin-shaped structure and the hollow structure during the plugging together of the plug connection.

Figure 1B:
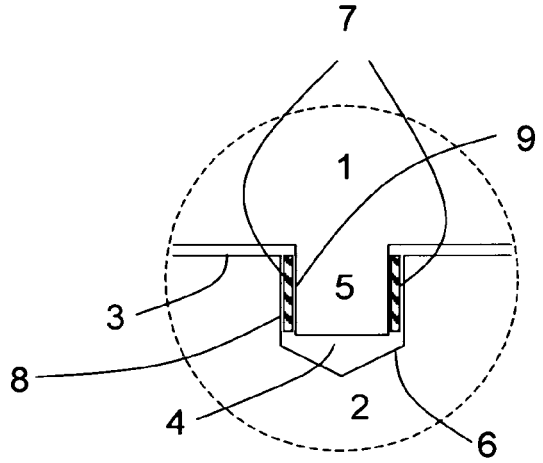
FIG. 1*b* shows a second exemplary embodiment of the arrangement according to the invention in a schematic manner.

The exemplary embodiment shown in FIG. 1*b* differs from the exemplary embodiment shown in FIG. 1*a* in that the air gap 4 is not delimited by parallel surfaces as in the exemplary embodiment shown in FIG. 1*a*, rather in that the hollow structure 6 of the exemplary embodiment shown in FIG. 1*b* runs conically downwards, as a result of which a non-substantially disappearing residual volume of the air gap 4, which is larger compared to FIG. 1*a*, results.

Figure 2A:
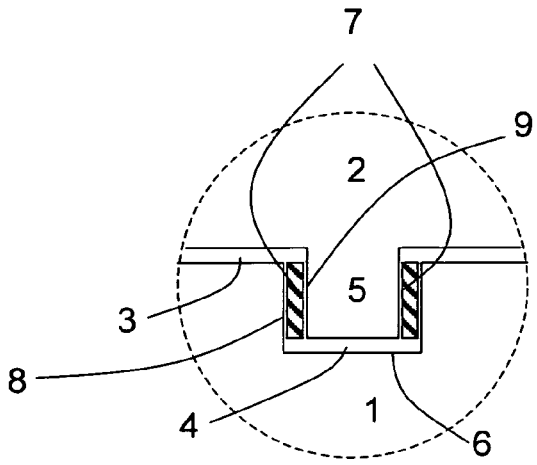
FIG. 2*a* shows a third exemplary embodiment of the arrangement according to the invention in a schematic manner.
Figure 2B:
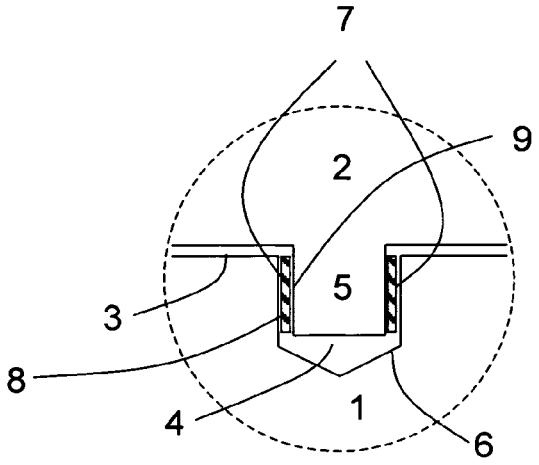
FIG. 2*b* shows a fourth exemplary embodiment of the arrangement according to the invention in a schematic manner.

The FIGS. 2*a* and 2*b* show further exemplary embodiments of the arrangement according to the invention, in which the pin-shaped structure 5 is not attached on the sliding contact element 1 as in the exemplary embodiments of FIGS. 1*a* and 1*b*, but rather on the current supply element 2. Accordingly, the hollow structures 6 which fit the pin-shaped structure 5 are attached in the sliding contact element 1.

Further exemplary embodiments result if, instead of a pin-shaped structure, a plurality of pin-shaped structures are provided. The stability of the plug connection (SF) can be increased further, if the walls 8 and 9 of the pin-shaped structure or the hollow structure are provided with groove profiles or other profile structures increasing the friction between the elastic fastening element and the walls.

Figure 3:
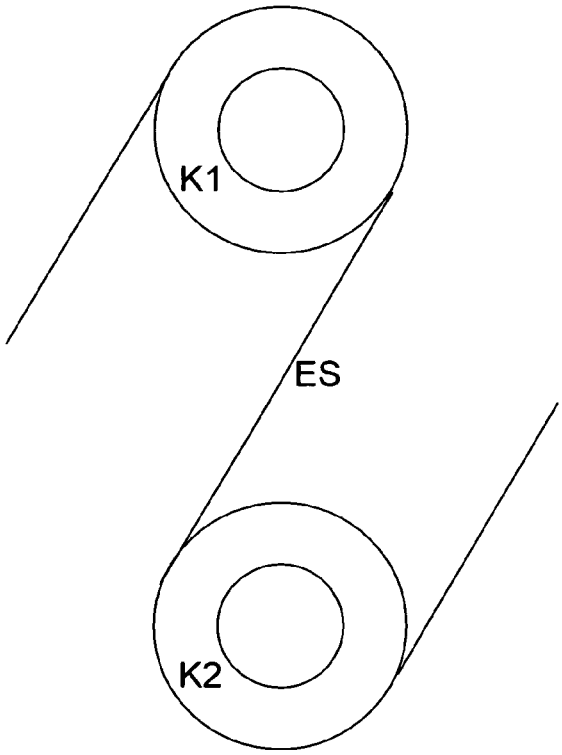
FIG. 3 shows a first partial view of an exemplary embodiment of the device according to the invention in a schematic manner.

FIG. 3 shows an exemplary embodiment of a device according to the invention in a partial view in a schematic manner, in which a wire runs over two contact rollers K1, K2, between which the wire passes through a heating section (ES).

Figure 4:
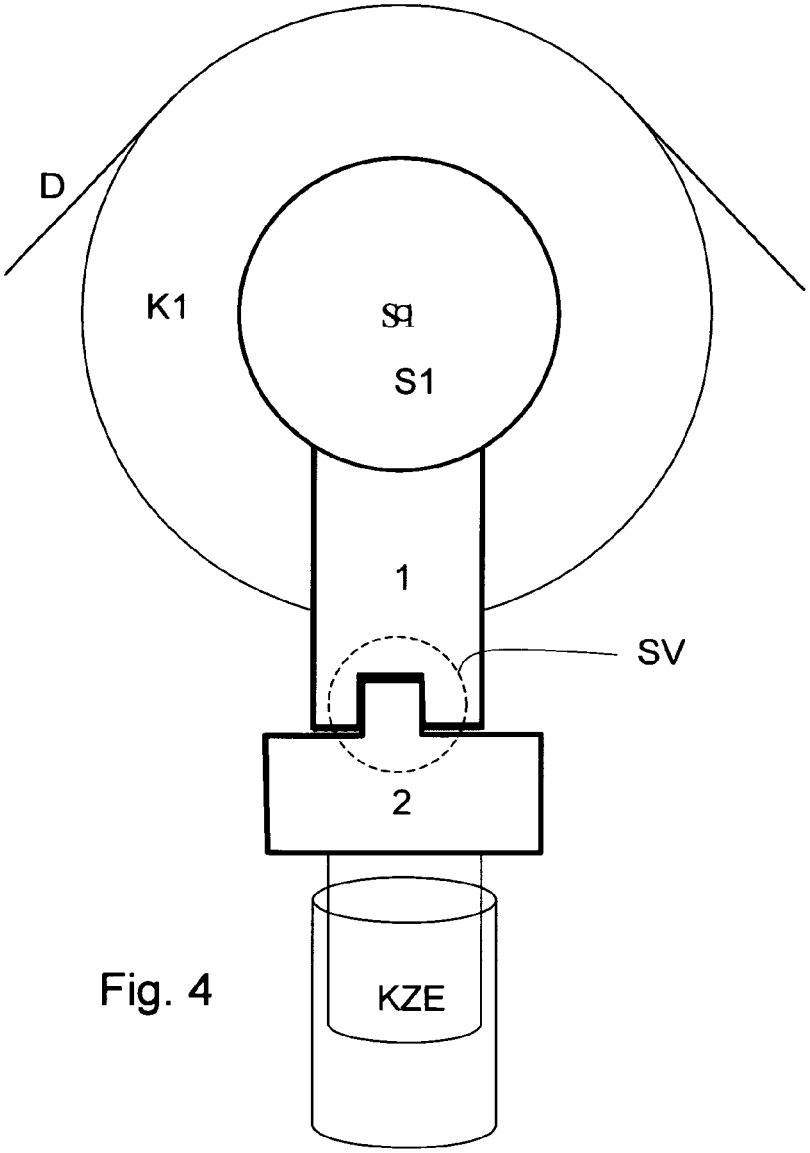
FIG. 4 shows a second partial view of an exemplary embodiment of the device according to the invention in a schematic manner.

FIG. 4 shows a further partial view of a device according to the invention, particularly a wire annealer, in a schematic manner. The wire (D) runs over a contact roller K1, with which a slip ring S1 is concentrically arranged. The sliding contact element 1 is attached on the current supply element 2 with the aid of a plug connection (SV), wherein the elastic and electrically conductive fastening element is not shown in this figure. The current supply element 2 is held and guided by a piston/cylinder apparatus (KZE).

The invention claimed is:

1. An arrangement, comprising:

a current supply element;

at least one sliding contact element on said current supply element by means of a plug connection, wherein said at least one sliding contact element is detached by being pulled off of said current supply element in a first direction relative to said current supply element;

said at least one sliding contact element including at least one pin-shaped structure and said current supply element including at least one hollow structure, said at least one hollow structure being configured to fit said at least one pin-shaped structure; and at least one elastic and electrically conductive fastening element, wherein the pin-shaped structure, the hollow structure and the at least one elastic and electrically conductive fastening element are configured in such a manner that the elastic and electrically conductive fastening element is placed in said hollow structure between mutually fitting walls of the pin-shaped structure and the current supply element during the plugging together of the plug connection, and wherein said electrically conductive fastening element is removed from said at least one hollow structure in said first direction.

2. The arrangement according to claim 1, in which at least one fastening element annularly surrounds at least one pin-shaped structure at least to some extent.

3. The arrangement according to claim 1, in which the at least one sliding contact element is a carbon brush.

4. The arrangement according to claim 1, in which said at least one fastening element consists of an elastic plastic at least to some extent.

5. A method for supplying current to a movable conductor, comprising:

providing a sliding contact element including at least one pin-shaped structure;

arranging said contact element on a current supply element by means of a plug connection, said current supply element including at least one hollow structure configured to fit said at least one pin-shaped structure, said sliding contact element is detached from said current supply element by being pulled off of said current supply element in a first direction relative to said current supply element;

providing at least one elastic and electrically conductive fastening element in said at least one hollow structure between mutually fitting walls of the pin-shaped structure and said at least one hollow structure during the plugging together of the plug connection, wherein said electrically conductive fastening element is removed from said at least one hollow structure in said first direction.

6. The method according to claim 5, with a sliding contact configured as a carbon brush.

* * * * *